US006347745B1

(12) United States Patent
McClure

(10) Patent No.: US 6,347,745 B1
(45) Date of Patent: Feb. 19, 2002

(54) ENGINE THERMOSTAT HOUSING AND THERMOSTAT ASSEMBLY

(75) Inventor: Samuel Aaron McClure, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/746,458

(22) Filed: Dec. 21, 2000

(51) Int. Cl.[7] ..... F01P 7/02
(52) U.S. Cl. ..... 236/34.5; 137/468
(58) Field of Search ..... 236/34, 34.5; 137/468; 251/367

(56) References Cited

U.S. PATENT DOCUMENTS 4,431,133 A * 2/1984 Roberson, Sr. ..... 236/34.5
4,562,953 A * 1/1986 Duprez et al. ..... 236/34.5
4,653,688 A 3/1987 Grinsteiner ..... 236/34.5
5,749,515 A * 5/1998 Duprez ..... 236/34.5
5,881,757 A 3/1999 Kuster et al. ..... 137/15
5,967,101 A * 10/1999 Roth et al. ..... 236/92 R
6,047,726 A * 4/2000 Kaneshige ..... 137/468

* cited by examiner

*Primary Examiner*—William E. Tapolcal
*Assistant Examiner*—Mohammad M. Ali

(57) ABSTRACT

A thermostat assembly with a valve mounted to a carrier for installation in an engine thermostat housing. The carrier includes a body portion to which the valve is mounted. A pair of posts extend upward from the body portion and have snap tabs that seat in an annular groove in the thermostat housing. A handle extends from the side posts and includes legs that first project inward from the side posts and then upward to upper distal ends where a cross member connects the legs. The carrier is made of plastic such that when the legs are squeezed together, the side posts deflect to withdraw the snap tabs from the groove to withdraw the snap tabs and enable the carrier to be removed from the housing. The housing also includes an inwardly tapered portion that engages the body portion of the carrier to form a seal therebetween. Fluid pressure when the valve is closed deflects the carrier outward into firm engagement with the condiut.

10 Claims, 1 Drawing Sheet

ENGINE THERMOSTAT HOUSING AND THERMOSTAT ASSEMBLY

BACKGROUND OF THE INVENTION

1. Field of the Invention

The present invention relates to a thermostat assembly for installation into a thermostat housing in an engine to control coolant flow therethrough and in particular to an improved means for mounting the thermostat in the engine thermostat housing.

2. Description of Related Art

A conventional thermostat for an engine includes a valve member that is biased to a closed position by a spring and has a capsule of expandable material, such as wax, that expands when heated to move the valve member in opposition to the spring to an open position. The thermostat is often carried in a metal carrier that is placed into a thermostat housing in the engine and held in place therein. The carrier may be held in place by a radiator cap or other easily removed structure for replacement of a faulty thermostat.

SUMMARY OF THE INVENTION

The present invention provides an improved thermostat assembly in which the carrier is made of a resilient plastic material and has a handle that is easily manipulated to release the carrier from the engine thermostat housing. In the preferred embodiment, the thermostat housing is a circular coolant fitting integrally formed in the timing gear cover or in a separate housing attached to the cylinder head. The fitting is a cylindrical conduit to which a radiator hose can be attached. The conduit has an annular groove on the inner surface thereof and an inwardly tapered portion spaced from the groove.

The thermostat assembly includes a flow control valve operable in response to the temperature of the coolant to open and close to permit or prohibit flow of a coolant through the valve. The carrier is preferably made of a thermal plastic resin in a single piece molding and carries the valve. The carrier has an annular body portion closely fitting to the inside of the thermostat housing conduit. The body portion includes means to mount the valve therein. The carrier further has a pair of opposite side posts extending axially from the body portion. The posts have outwardly projecting snap tabs that seat within the groove in the housing to hold the carrier therein.

The carrier further includes a handle portion with legs that extend, first inwardly from the upper ends of the side posts and then upwardly to upper distal ends. A cross member connects the upper distal ends of the handle legs. The legs of the handle and side posts are resilient to enable the legs to be pushed radially inward toward one another. This moves the snap tabs radially inward to withdraw them from the grooves in the conduit to enable the carrier and the valve to be removed from the engine thermostat housing. Alternatively, the handle legs can extend both upward and outward to the upper distal ends.

The inner surface of the engine thermostat housing has an inward tapered portion. The carrier body portion engages and seals against the taper portion of the conduit when the snap tabs are seated in the groove. This eliminates the need for a separate O-ring seal between the carrier and the housing. When the valve is closed, fluid pressure acts on the carrier upstream of the valve to push the carrier outward, against the tapered surface of the conduit. The fluid pressure thus helps to create the seal between the carrier and the conduit.

DESCRIPTION OF THE PREFERRED EMBODIMENT

Figure 2:
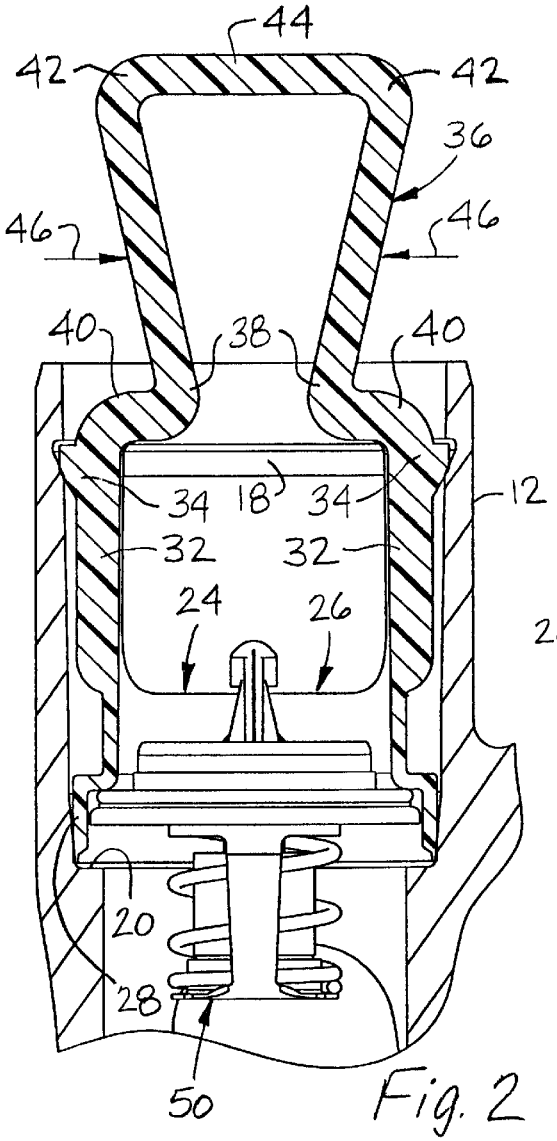
FIG. 2 is a sectional view of the engine thermostat housing and thermostat assembly as seen from substantially the line 2—2 of FIG. 1.
Figure 1:
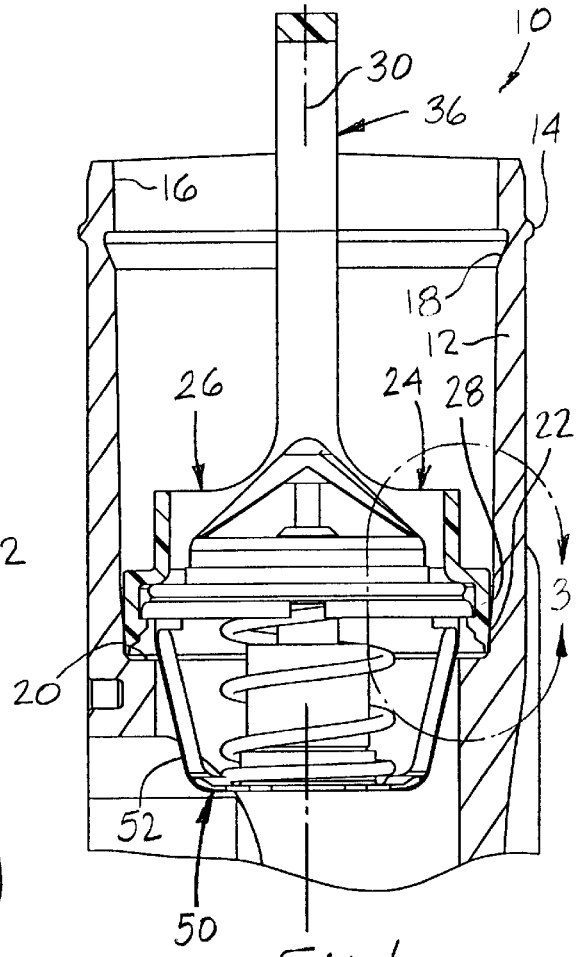
FIG. 1 is a sectional view of the engine thermostat housing and thermostat assembly of the present invention.

The engine thermostat housing and thermostat assembly of the present invention is shown in FIGS. 1 and 2 and designated generally at 10. The thermostat housing includes a generally cylindrical conduit 12. The conduit 12 is preferably a cast aluminum fitting for a radiator hose through which coolant flows from an engine to a radiator. The exterior of the housing has a raised bead 14 for retaining a hose clamp used to secure a hose to the conduit 12. The inner cylindrical surface 16 of the conduit is formed with an annular groove 18 that is used to retain the thermostat assembly as described below. At the opposite end of the conduit 12, there is a radially inwardly extending stop ledge 20. Near the stop ledge, the inner surface 16 has an inwardly tapered portion 22.

A one-piece carrier 24 is secured in the conduit 12. The carrier has an annular body portion 26 that includes a sidewall or skirt 28. The sidewall 28 engages the tapered portion 22 of the conduit 12 and forms a seal thereon. The conduit 12 and the annular body portion of the carrier define an axis 30.

The carrier 24 has a pair of side posts 32 on diametrically opposite sides that extend upward from the body portion 26. The side posts extend upwardly and have outwardly extending snap tabs 34 that seat within the groove 18 on the inner surface of the conduit 12. When the snap tabs 34 are in the groove 18, the sidewall 28 of the body portion is pressed against the tapered portion 22 of the conduit inner surface to form a seal.

A handle portion 36 extends upwardly from the side post 32. The handle portion 36 includes leg 38 that first extends inward from the upper ends 40 of the side posts and then upwardly and outwardly to upper ends 42. A cross member 44 connects the two upper ends of the legs 38. The legs 38 can be moved inward by pushing inward as shown by the arrows 46. This deflects the side posts inwardly to retract the snap tabs 34 from the annular groove 18. Once the snap tabs are retracted, the carrier 24 can be withdrawn from the conduit 12.

Figure 4:
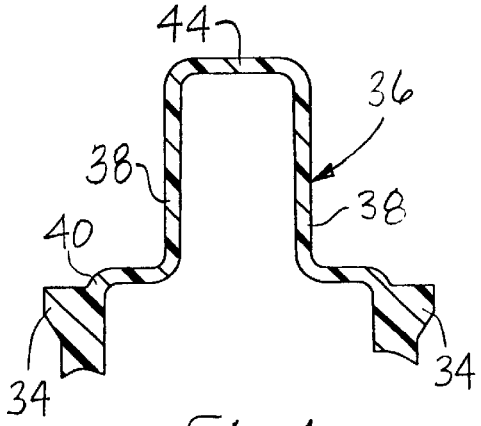
FIG. 4 is a fragmentary elevational view of the upper portion of the retaining illustrating an alternative embodiment.
Figure 3:
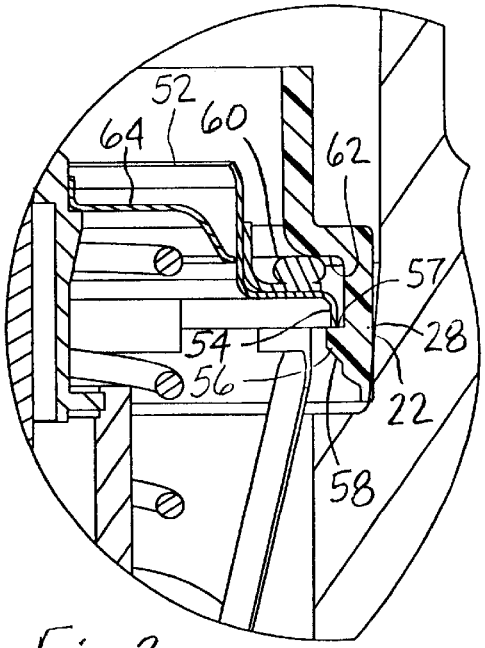
FIG. 3 is an enlarged section view of the portion of FIG. 1 enclosed in the circle 3.

An alternative embodiment of the handle portion 36 is shown in FIG. 4. There the legs 38 extend upward, but not outward, to the upper distal ends 42.

A flow control valve 50 is mounted to the carrier 24 and is thus held in place in the conduit 12. The flow control valve 50 has a metal frame 52 that is sealed to and fixed to the carrier. The frame 52 has a downward depending skirt 54 adjacent the inner surface of the carrier body portion 26. The body portion of the carrier has a pair of inward projecting tabs 56 each forming an upward facing ledge 57. The tabs 56 are diametrically opposite one another and extend circumferentially approximately 45° around the carrier. The valve is installed in the carrier by pushing the valve upward, as viewed in the drawings, into the body portion. The metal frame of the valve pushes outward on the inclined surface 58 of each tab 56, deflecting the carrier body portion into an oval shape until the valve frame passes the tabs 56. The carrier then returns to its nominal position. Other ways to fasten the valve to the carrier are known, any one of which could be used with the carrier of the present invention.

The valve 50 has a seal member 60 that engages a ledge 62 in the carrier body portion to form a seal between the flow control valve and the carrier. The flow control valve also includes a movable valve member 64 that is movable away from the frames 52 in a known manner for an engine thermostat. The valve member 64 moves axially between the closed position shown in the figures to an open position to allow fluid to flow between the valve member 64 and the frame 52.

When the valve is closed, fluid pressure below the valve acts on the skirt to push the skirt outward against the tapered portion 22 of the conduit. The pressure acts to "self-energize" the seal between the conduit and the valve. As the pressure of the fluid restrained by the valve increases, the sealing force between the carrier and the conduit also increases.

The seal 60 between the valve and the carrier is slightly radially inward of the snap tabs 34 on the side posts 32. Fluid pressure on the valve thus creates a moment on the side posts that forces the snap tabs into the groove 18.

The thermostat assembly consisting of the carrier and the flow control valve includes a handle that is easily manipulated to remove the assembly from the conduit 12 for replacement of the valve. The thermostat assembly is removed by simply pushing inward on the legs 38 to retract the tabs 34 from the groove 18 and then lift the assembly out of the conduit 12. The provision of the tapered portion 22 in the conduit 12 provides a seal between the conduit and the carrier.

The invention should not be limited to the above-described embodiment, but should be limited solely by the claims that follow.

I claim:

1. Thermostat assembly comprising:

a flow control valve operable in response to temperature of a fluid to open and close to permit or prohibit flow of the fluid through the valve; and a carrier supporting the valve, the carrier having an annular body portion defining an axis, the body portion including means to mount the valve therein, the carrier further having a pair of diametrically opposite side posts extending axially from the body portion, the side posts having outwardly projecting snap tabs, and the carrier further having a handle portion with legs that extend first inward from upper ends of the side posts and then upward to upper ends, and the handle portion further having a cross member connecting upper ends of the two legs, the legs of the handle and the side posts being resilient to enable the legs to be pushed radially inward toward one another to move the snap tabs radially inward.

2. The thermostat assembly as defined by claim 1 wherein the carrier is made of a thermoplastic resin.

3. The thermostat assembly as defined by claim 1 wherein the legs extend of the handle portion extend both upward and outward to the upper ends of the legs.

4. The thermostat assembly as defined by claim 1 wherein the snap tabs are located on the side posts adjacent the upper ends thereof.

5. Thermostat and engine thermostat housing assembly comprising:

cylindrical conduit for fluid flow therethrough, the conduit having an inner surface with an annular snap groove therein and an inwardly extending stop ledge spaced from the groove, the inner surface of the conduit further having an inward taper adjacent the stop ledge between the stop ledge and the groove;

a flow control valve operable in response to temperature of a fluid in the conduit to open and close the valve to permit or prohibit flow of the fluid therethrough; and a carrier supporting the valve, the carrier having an annular body portion defining an axis, the body portion including means to mount the valve therein, the body portion being sized to closely fit in the cylindrical conduit and engage the inward taper portion of the conduit, the carrier further having a pair of diametrically opposite side posts extending axially from the body portion, the side posts having outwardly projecting snap tabs seated in the groove in the conduit to hold the carrier firmly in place with the body portion engaging the taper portion of the conduit, and the carrier further having a handle portion with legs that extend first inward from upper ends of the side posts and then upward to upper distal ends and a cross member connecting upper ends of the two legs, the legs of the handle and the side posts being resilient to enable the legs to be pushed radially inward toward one another to move the snap tabs radially inward.

6. The thermostat assembly as defined by claim 5 wherein the carrier is made of a thermoplastic resin.

7. The thermostat assembly as defined by claim 5 wherein the legs extend of the handle portion extend both upward and outward to the upper ends of the legs.

8. The thermostat assembly as defined by claim 5 wherein the snap tabs are located on the side posts adjacent the upper ends thereof.

9. The thermostat and housing assembly as defined by claim 5 wherein the body portion has a cylindrical skirt that extends below the means for mounting the valve therein to form the outer cylindrical wall that engages the taper portion of the conduit.

10. Thermostat and engine thermostat housing assembly comprising:

cylindrical conduit for fluid flow therethrough;

a flow control valve operable in response to temperature of a fluid in the conduit to open and close the valve to permit or prohibit flow of the fluid therethrough;

a carrier supporting the valve;

means on the carrier and the conduit cooperating with one another to mount the carrier in the conduit; and the carrier further having an annular skirt on the upstream side of the valve that is resilient to deflect outward under fluid pressure when the valve is closed into firm engagement against the conduit.

* * * * *